US007034294B2

(12) United States Patent
Schwartz et al.

(10) Patent No.: US 7,034,294 B2
(45) **Date of Patent: *Apr. 25, 2006**

(54) TWO-DIMENSIONAL QUADRUPOLE ION TRAP OPERATED AS A MASS SPECTROMETER

(75) Inventors: Jae C. Schwartz, San Jose, CA (US); Viatcheslav V. Kovtoun, Santa Clara, CA (US); Michael W. Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/922,636

(22) Filed: Aug. 19, 2004

(65) Prior Publication Data

US 2005/0017170 A1 Jan. 27, 2005

Related U.S. Application Data

(63) Continuation-in-part of application No. 10/357,712, filed on Feb. 3, 2003, now Pat. No. 6,797,950.

(60) Provisional application No. 60/354,389, filed on Feb. 4, 2002, provisional application No. 60/355,436, filed on Feb. 5, 2002.

(51) Int. Cl.
*H01J 49/42* (2006.01)

(52) U.S. Cl. ..... 250/292

(58) Field of Classification Search ..... None
See application file for complete search history.

(56) References Cited

U.S. PATENT DOCUMENTS

| | | | | |
|---|---|---|---|---|
| 5,420,425 | A | 5/1995 | Bier et al. | |
| 5,576,540 | A | 11/1996 | Jolliffe | |
| 5,750,993 | A | 5/1998 | Bier | |
| 5,962,851 | A | 10/1999 | Whitehouse et al. | |
| 6,069,355 | A | 5/2000 | Mordehai | |
| 6,331,702 | B1 | 12/2001 | Krutchinsky et al. | |
| 6,344,646 | B1 | 2/2002 | Kato | |
| 6,392,225 | B1 | 5/2002 | Schwartz et al. | |
| 6,545,268 | B1 | 4/2003 | Verentchikov et al. | |
| 6,797,950 | B1 * | 9/2004 | Schwartz et al. | 250/292 |

FOREIGN PATENT DOCUMENTS

WO PCT/US03/3492 4/2003

* cited by examiner

*Primary Examiner*—Jack I. Berman
(74) *Attorney, Agent, or Firm*—Sharon Upham

(57) ABSTRACT

A three section linear or two-dimensional (2D) quadrupole ion trap as a high performance mass spectrometer is described. Mass analysis is performed by ejecting ions radically out slots formed in at least two of the rods using the mass selective instability mode of operation. The slot geometry is optimized to enable ions of different mass ranges to be scanned out of differently dimensioned slots. Multiple detectors arranged to receive ejected ions in multiple directions provide the ability to simultaneously or sequentially scan or perform mass analysis of ions of different natures.

39 Claims, 5 Drawing Sheets

Figure 4
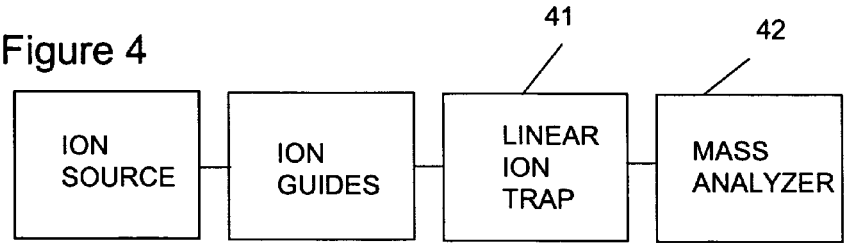
Figure 5
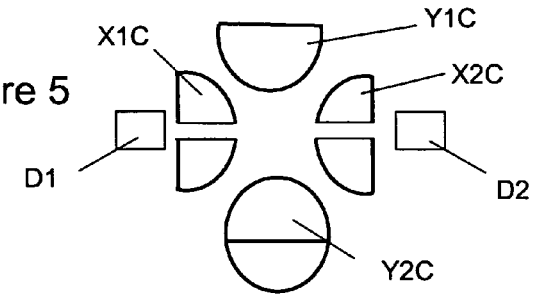
Figure 7
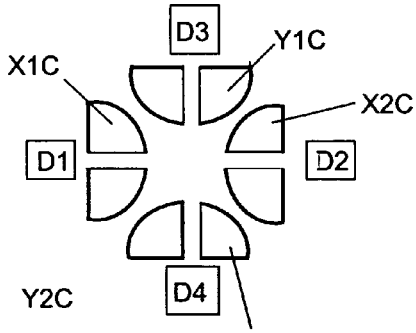
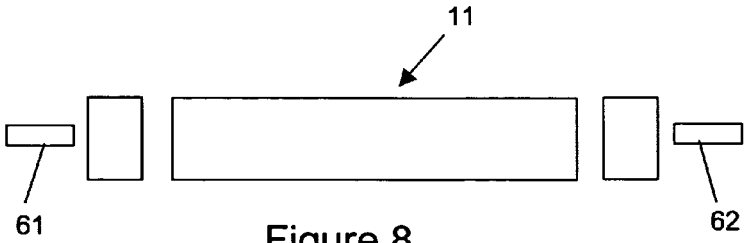
Figure 8

TWO-DIMENSIONAL QUADRUPOLE ION TRAP OPERATED AS A MASS SPECTROMETER

RELATED APPLICATIONS

This application is a continuation-in-part of U.S. application Ser. No. 10/357,712, filed Feb. 3, 2003, now U.S. Pat. No. 6,797,950, which claims priority to Provisional Application Ser. No. 60/354,389 filed Feb. 4, 2002 and Provisional Application Ser. No. 60/355,436 filed Feb. 5, 2002.

BRIEF DESCRIPTION OF THE INVENTION

This invention relates generally to a two-dimensional quadrupole ion trap operated as a mass spectrometer and more particularly to such a spectrometer providing improved trapping efficiency, increased trapping capacity and excellent mass resolution.

BACKGROUND OF THE INVENTION

Two-dimensional (2D) radio frequency multipole ion traps have been used for several years for the study of spectroscopic and other physical properties of ions. The earliest application of 2D multipole ion traps in mass spectrometry involved the use of the collision cell of a triple quadrupole instrument for studying ion-molecule reactions. More recently, multipole ion traps have been used in mass spectrometers as part of hybrid systems including Fourier transform ion cyclotron resonance (FTICR), time-of-flight (TOF), and standard three-dimensional (3D) ion trap mass spectrometers.

Syka and Fies have described the theoretical advantages of 2D versus 3D quadrupole ion traps for Fourier transform mass spectrometry (U.S. Pat. No. 4,755,670). These advantages include reduced space charge effects due to the increased ion storage volume, and enhanced sensitivity for externally injected ions due to higher trapping efficiencies. Bier and Syka described several forms of linear and circular 2D ion traps with large ion capacity to be used as mass spectrometers (U.S. Pat. No. 5,420,425) using the mass selective instability mode of operation similar to that used in all commercial three-dimensional (3D) quadrupole ion trap instruments.

A linear ion trap includes two pairs of electrodes or rods, which contain ions by utilizing an RF quadrupole trapping field in two dimensions, while a non-quadrupole DC trapping field is used in the third dimension. Simple plate lenses at the ends of a quadrupole structure can provide the DC trapping field. This approach, however, allows ions which enter the region close to the plate lenses to be exposed to substantial fringe fields due to the ending of the RF quadrupole field. These non-linear fringe fields can cause radial or axial excitation which can result in loss of ions. In addition, the fringe fields can cause shifting of the ions frequency of motion in both the radial and axial dimensions.

An improved electrode structure of a linear quadrupole ion trap 11, which is known from the prior art, is shown in FIG. 1. The quadrupole structure includes two pairs of opposing electrodes or rods, the rods having a hyperbolic profile to substantially match the equipotential contours of the quadrupole RF fields desired within the structure. Each of the rods is cut into a main or central section and front and back sections. The two end sections differ in DC potential from the central section to form a "potential well" in the center to constrain ions axially. An aperture or slot 12 allows trapped ions to be selectively resonantly ejected in a direction orthogonal to the axis in response to AC dipolar or quadrupolar electric fields applied to the rod pair containing the slotted electrode. In this figure, as per convention, the rod pairs are aligned with the x and y axes and are therefore denoted as the X and Y rod pairs.

FIGS. 2*a*–2*c* schematically show the voltages needed to operate this linear ion trap as a mass spectrometer. These voltages include three separate DC voltages, DC1, DC2 and DC3, (typical range of 0 to +/−100 volts) applied to the electrodes of the front, center, and back sections to produce the injection and axial trapping fields (FIG. 2*a*), two phases of primary RF voltage (typical value of +/−5KV, with frequencies in the 1 MHz range) applied to opposite rod pairs of the three sections to produce the radial trapping fields (FIG. 2*b*), and, two phases of the AC resonance excitation voltage (typical range of +/−100V, 5–500 kHz) applied to the pair of electrodes which include the ejection slot(s) for isolation, activation, and ejection of ions (FIG. 2*c*).

When using a linear ion trap operated in the resonance ejection mass instability mode, the mass spectra and resolution are controlled by many of the same processes in the linear ion trap as in a three-dimensional ion trap such as described in U.S. Pat. Nos. 4,540,884 and 4,736,101. However, unlike most three-dimensional ion traps where the trap structure does not require high mechanical tolerances, the performance of a two-dimensional ion trap is more susceptible to mechanical errors. In a three-dimensional ion trap, all of the ions occupy a spherical or ellipsoidal space at the center of the trap typically of a cloud size of 1 mm in diameter. The ions in a two-dimensional ion trap, however, are spread out along a substantial fraction of the entire length of the trap in the axial direction which can be several centimeters or more. Therefore, one could imagine that if the quadrupole rods are not completely parallel, then ions at different axial positions within the trap will experience a slightly different field strength. This variation in field strength experienced will in turn cause ejection times during mass analysis which are dependent on the ions axial position. The result is increased overall peak widths and degraded resolution. In such a device, if the axial spread of the ion cloud could be reduced using, for example, higher end-section DC voltages, then a smaller variation of q values would be obtained and better resolution would result. This could compromise ion storage volume or space charge capacity for this device, but could make a distorted device into a usable mass spectrometer.

Other parameters also contribute to the overall performance of the linear trap as a mass spectrometer. When using a mass selective instability scan in a linear ion trap, the ions are ejected from the trap in a radial direction. Some researchers have ejected ions between two of the quadrupole rods. However, due to high field gradients loss of ions is substantial. The more efficient way is to eject the ions through a rod by introducing a slot in the rod. For the linear ion trap, the preferred operation is a slot cut along the length of the rod. When a slot (or slots) is cut into one or more of the linear ion trap electrodes to allow ions to be ejected from the device, the electric fields are degraded from the theoretical quadrupole field and therefore the presence of this slot can impact several important performance factors. Consequently, the characteristics of this slot are significant. It should also be noted, that distortion of the electric fields can also be caused by truncation of the hyperbolic surface of the electrodes. Similar to the effects of the slots, these effects also cause field faults and so the overall performance will depend on the combined effects of the slots and the truncation. Normally these truncation effects are small relative to the slots, however the possibility of using their interaction to optimize overall performance exists.

OBJECTS AND SUMMARY OF THE INVENTION

It is a general object of the present invention to provide an improved linear ion trap and mass spectrometer incorporating such an ion trap.

An object of the present invention is to provide an improved two-dimensional linear ion trap and mass spectrometer incorporating such an ion trap, in which the dimensions of the ejection slots formed in the electrodes are optimized for operation of the trap such that ions of different natures, such as different mass ranges, charge states, ion polarity (positive or negative ions) are scanned out of differently dimensioned slots.

It is a further object of the present invention to provide a two-dimensional linear ion trap and mass spectrometer incorporating such an ion trap, in which the linear ion trap includes multiple detectors arranged to receive ejected ions in multiple directions to provide the ability to simultaneously or sequentially scan or perform mass analysis of ions of different natures.

DESCRIPTION OF FIGURES

The foregoing and other objects of the invention will be more clearly understood from the following description when read in connection with the accompanying drawings of which:

FIG. 4 shows a tandem mass spectrometer incorporating a linear ion trap;

FIG. 5 is a sectional view of the center section of the linear ion trap illustrating the use of two detectors;

FIG. 7 is a sectional view of the center section of the linear ion trap illustrating the use of four detectors; and FIG. 8 is a schematic view of a linear ion trap with ion injection into the trap from both ends of the trap.

DESCRIPTION OF PREFERRED EMBODIMENT

Figure 1:
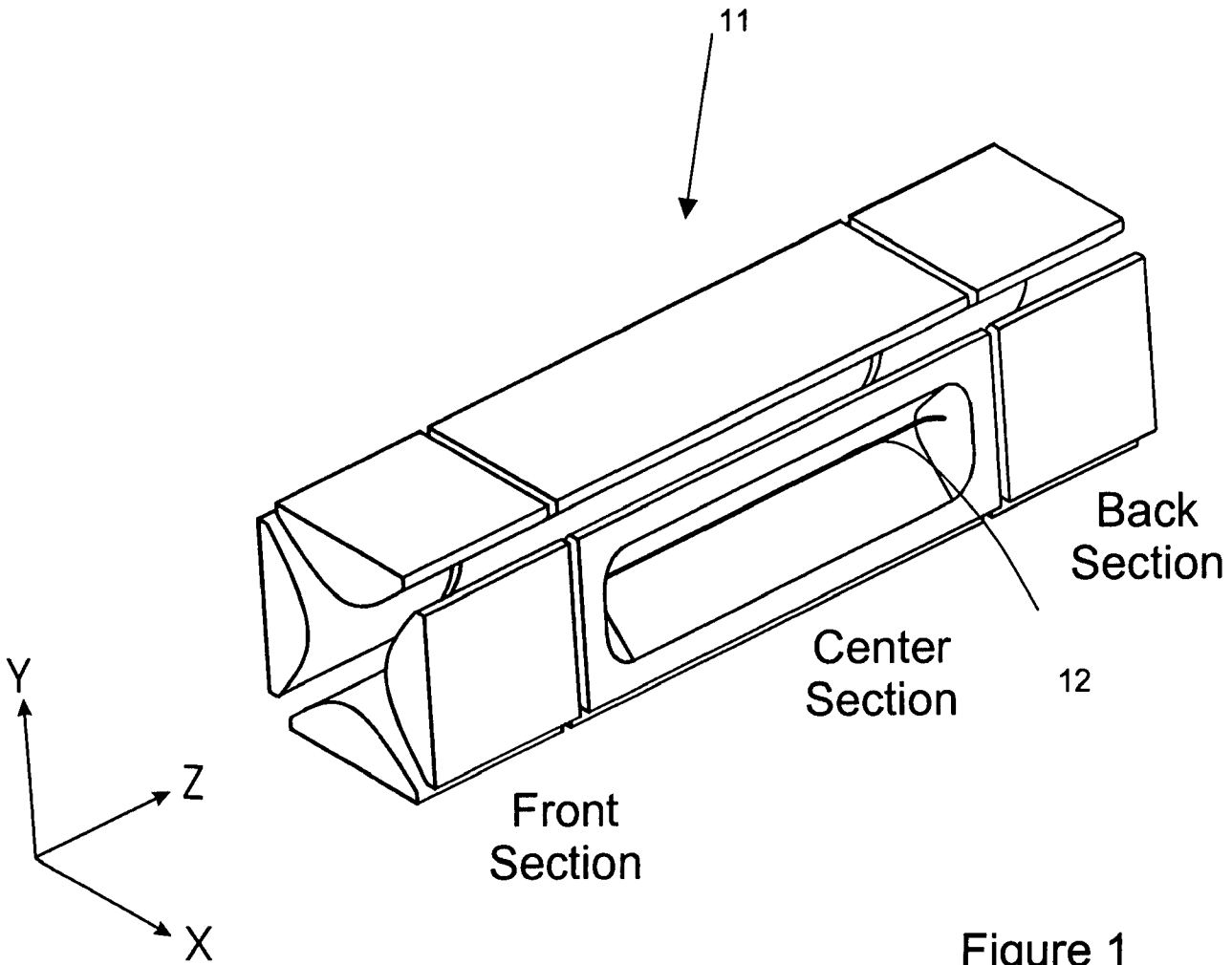
FIG. 1 is a perspective view illustrating the basic design of a two-dimensional linear ion trap.
Figure 2A:
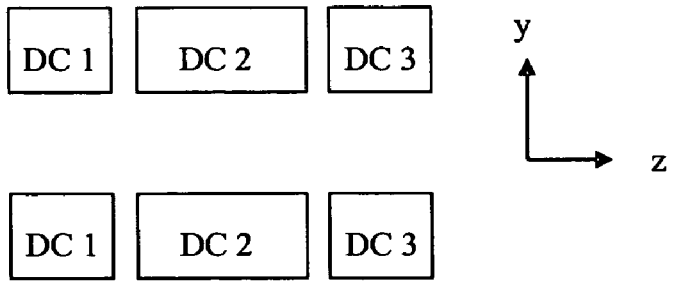
FIGS. 2*a*–2*c* illustrate the DC, RF trapping, and AC excitation voltages necessary for operation of the two-dimensional ion trap.
Figure 2B:
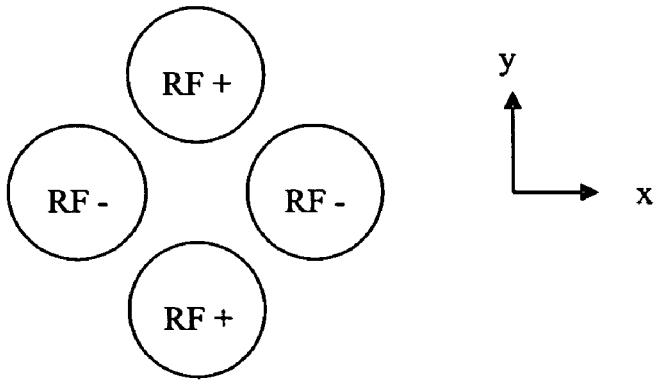
Figure 2C:
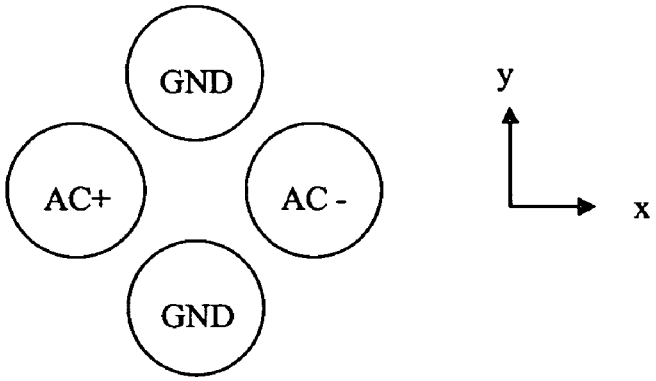
Figure 3:
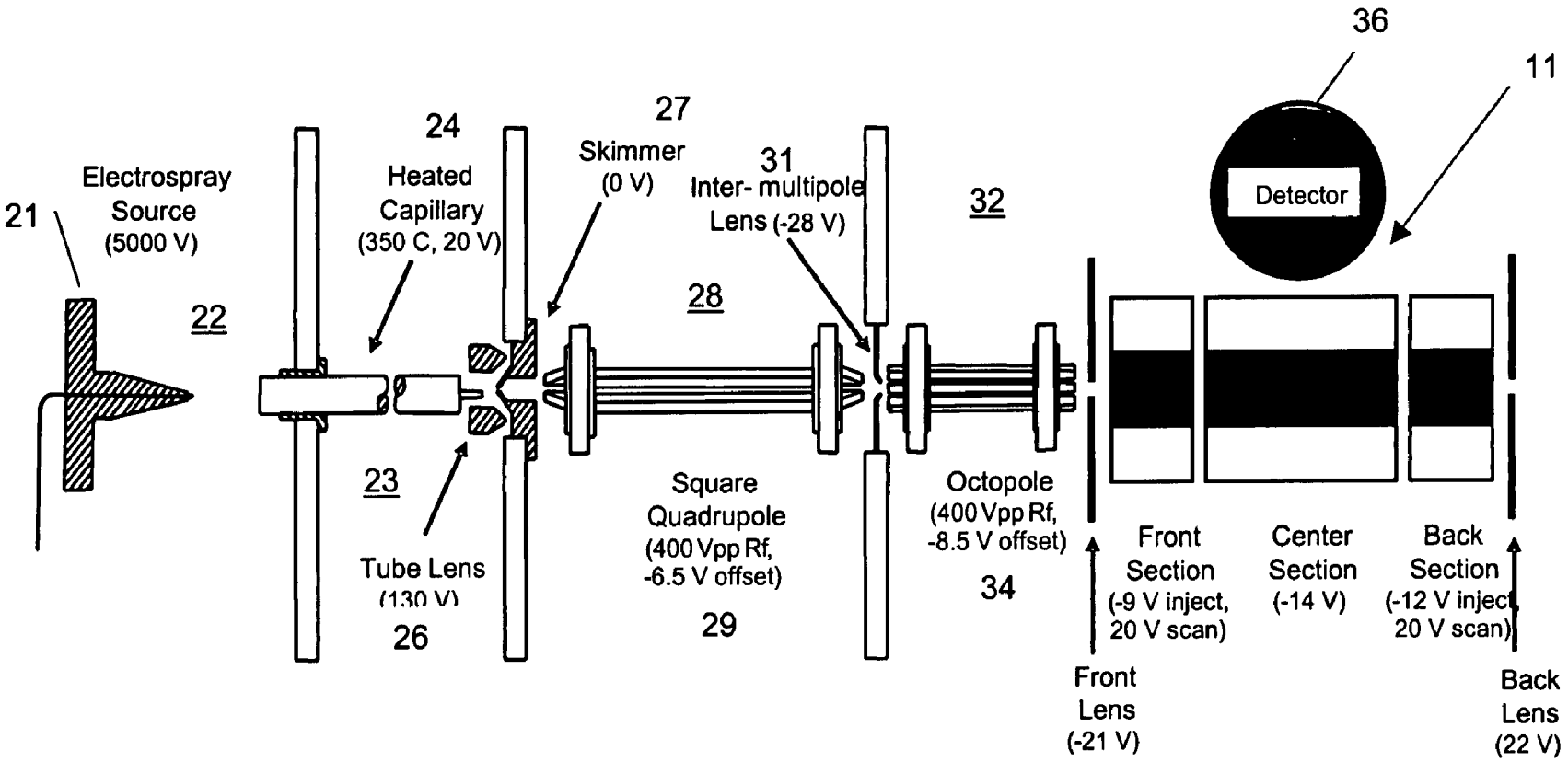
FIG. 3 shows a mass spectrometer instrument configuration along with typical operating voltages.

Referring to FIG. 3 a typical linear ion trap mass spectrometer instrument is schematically illustrated. The instrument includes a suitable ion source such as the electrospray ion source 21 in a chamber 22 at atmospheric pressure. Other types of ion sources which may be accommodated by the instrument comprise atmospheric pressure chemical ionization (APCI), atmospheric pressure photo-ionization (APPI), matrix assisted laser desorption ionization (MALDI), atmospheric pressure-MALDI (AP-MALDI), electron impact ionization (EI), chemical ionization (CI), an electron capture ionization (ECI) source, a fast atom bombardment (FAB) source and a secondary ions (SIMS) source. Ions formed in the chamber 22 are conducted into a second chamber 23, which is at a lower pressure such as 1.0 Torr via a heated capillary 24 and directed by a tube lens 26 into skimmer 27 in a wall of a third chamber 28 that is at still a lower pressure, for example, $1.6\times10^{-3}$ Torr. A heated capillary and tube lens is described in U.S. Pat. No. 5,157,260.

The ions entering the third chamber 28 are guided by quadrupole ion guide 29 and directed through inter-multipole lens 31 to the vacuum chamber 32 at a still lower pressure, for example $2\times10^{-5}$ Torr. This chamber houses the linear ion trap 11. An octapole ion guide 34 directs the ions into the two-dimensional quadrupole (linear) ion trap 11. Typical operating voltages, and temperature are indicated on the drawing. It is to be understood that other ion transfer arrangements can be used to transfer ions from the ion source at atmospheric pressures to the ion trap at the reduced pressure.

During ion injection, ions are axially injected into the linear trap by having the front rod section at for example, minus 9 volts, while the center section rod segments are at minus 14 volts, and the back section rod segments are at minus 12 volts. The ions are radially contained by the RF quadrupole trapping potentials applied to the X and Y rod sets. The ions are then axially trapped by switching the front and back sections to plus 20 volts while leaving the center section at minus 14 volts. In order to obtain a mass spectrum of the contained ions, the amplitude of the RF voltage is ramped linearly to higher amplitudes, while a dipolar AC resonance ejection voltage is applied across the rods in the direction of detection. Ions are ejected through the slot 12 in order of their mass-to-charge ratio (m/z) and are detected by an ion detector 36. Damping gas such as Helium (He) or Hydrogen ($H_2$), at pressures near $1\times10^{-3}$ Torr is utilized to help to reduce the kinetic energy of the injected ions and therefore increase the trapping and storage efficiencies of the linear ion trap This collisional cooling continues after the ions are injected and helps to reduce the ion cloud size and energy spread which enhances the resolution and sensitivity during the detection cycle.

The device described above can be used to process and store ions for later axial ejection into an associate tandem mass analyzer such as a Fourier transform mass analyzer, RF quadrupole analyzer, time of flight analyzer or three-dimensional ion trap analyzer. FIG. 4 schematically shows a tandem mass analyzer incorporating a linear quadrupole mass analyzer 41 as described above, and a tandem mass analyzer 42. The linear quadrupole analyzer 41 can analyze ions by resonance ejection or can eject unwanted ions and store ions for later analysis by the linear quadrupole analyzer 41 or eject them into a tandem mass analyzer 42 for analysis.

An important feature of the linear trap device is the aperture which allows ions to exit the device in order to be detected. Most preferably this aperture or apertures are slots cut axially along some portion of the length of the central section. In general, the presence of a slot introduces field faults distorting the quadrupolar field which, if not considered, can degrade the performance of the mass spectrometer yielding poor resolution and mass accuracy. This distortion, of course, is minimized by using as small a slot as possible, that is of small length and small width. However, the length and width of the slot directly determine how much of the ion cloud will actually be ejected from the trap and reach the detector, and therefore these dimensions are critical in determining sensitivity. Another aspect to be considered is that if the length of the slot is too long, the ions which are ejected through the portions of the slot which are at the ends of the center trapping section are influenced by the non-quadrupolar DC electric fields of the end sections. This causes ions of the same mass to be ejected at slightly different times than ions closer to the center of the trapping section, causing the resolution of the signal that reaches the detector to be degraded.

In addition, the length and width of the slot must be matched to the detector or a substantial fraction of the ions may not be focused onto the detector and will be lost. Hence, the cross-sectional area of the exiting cloud of ions must be designed appropriately for the detector dimensions.

Another consideration is field penetration from the detector, for example a conversion dynode which is held at very high potentials e.g. 15 KV, can also affect performance. This field penetration is minimized by keeping the slot width as small as possible.

In this example, the quadrupole trap structure has hyperbolic rod profiles with an $r_0$ of 4 mm, and the three axial rod sections have 12, 37, and 12 mm lengths respectively. The three sections, each with a discrete DC level, allow containment of the ions in the axial center of the device, avoiding any possible fringe field distortions of the trapping and resonance excitation fields in the center section.

In the preferred embodiment, the slot length is in the range of 80–95% of the overall length of the center section length for optimum performance. The slot in the present example was 30 mm long or substantially 81% of the 37 mm length of the center section. Slot length is considered to be optimum when substantially all the ions can be focused onto the detector, and the ions at the ends of the center trapping section are not substantially influenced by the non-quadrupolar DC electric fields of the end sections.

If the width of the slot is too large, poor resolution and mass accuracy may result, for reasons mentioned above. In the preferred embodiment, the slot width is in the range of 5–10% of the distances between the apex of the quadrupole rod and the axis of the quadrupole, $r_0$, and preferably substantially 6.25%. In our example, with a hyperbolic rod with an $r_0$ of 4 mm, an optimum slot width would be 0.250 mm. Slot widths within this range allow for highly efficient ion ejection (that is, ion ejection of greater than 80%) while keeping performance degradation at a minimum. Larger values can lead to a degraded resolution and mass accuracy, while not allowing significantly higher ejection efficiency.

For optimum transmission through the slot the width of the cross-sectional area of the exiting cloud of ions should ideally be able to pass through the slot without being "clipped", that is, without impinging on the peripheral walls of the slot itself. We have found that for a 4.00 mm $r_0$ rod, and a 0.25 mm slot width, a depth (or thickness) of 1.0 mm is the optimum value. A range of 3–5 times the slot width is preferred, with 4 times the slot width being optimum. It is also critical to ejection efficiency that the slot be positioned such that its center is substantially in line with the apex of the hyperbola of the rod itself. Preferably, the center of the slot is in the range of +/−0.1 mm (2.5% of $r_0$) from the apex of the hyperbola of the rod. The deviation of the slot width along the length of the rod also plays an important part in selection of this parameter. Preferably, the deviation is in the range of +/−0.05 mm (1.25% of $r_0$). The slot may not be of substantially uniform cross section as it extends from one side of the electrode to the other side of the electrode. Although the absolute values may change, the percent values should still apply even if the radii of the electrodes are changed. For example, electrodes of reduced radii provide numerous benefits to be attained, such as the extension of the m/z range without changing the maximum RF voltage used. Extension of the m/z range is a desirable feature for example in the majority of MALDI ion source applications, which produce primarily singly charged ions. Alternatively, this extended mass range could be compromised for the ability to increase the drive frequency which could provide for higher resolutions, storage capacities and scan rates. However, these benefits are only achievable if the quality of the quadrupole field can be maintained. As the radii of the rods is decreased, while the slot size does not change, the relative size of the ejection slots becomes larger, and would contribute to increasing the distortions in the electric fields. In the case of a 2 mm radius rod, if the slot width of 0.25 mm is retained (as in the case of the 4 mm rod), this would make the slots appear twice the size, requiring further corrections of the rod geometries to provide acceptable fields. The size of the slots could be reduced with the radius of the trap to keep the percent size similar, however it does have the risk that they become small enough that ejection efficiency is reduced and/or fabrication becomes difficult. The advantages of a linear ion trap with 2 mm rods is that an increase in mass range of a factor of four is achieved. Alternatively, the mass range can be kept the same, but the drive frequency can be increased to twice the value as compared to that used with 4 mm rods. This increased operating frequency helps increase storage capacity, scan rates, or to achieve higher resolution, although more power would be required from the RF electronics.

The number of slots used in the device can be varied for several reasons. First, to help determine or define the kind of field faults created by the slots themselves. For example, as mentioned above, if only one slot in one rod is used, large amounts of odd-ordered fields such as dipole and hexapole fields are generated. Whereas, if two slots of identical size are used on opposing rods, even order fields such as the quadrupole and octopole fields are effected. These different kinds of fields are known to cause increased or decreased performance in terms of mass accuracy and resolution. Consequently, the magnitude of each of these different field types can be tailored using the number and dimensions of the slots in this device.

Figure 6:
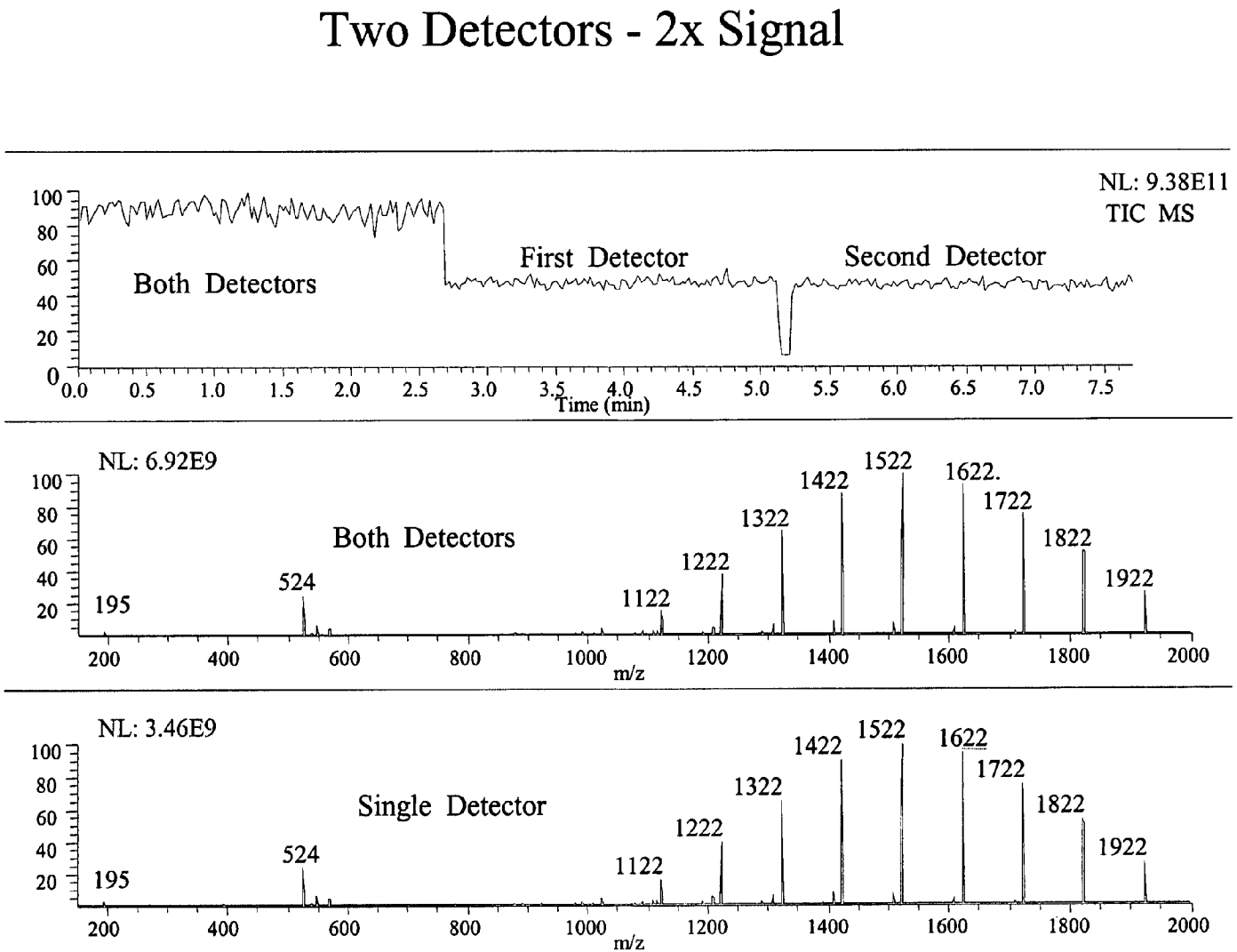
FIG. 6 shows the relative abundance of ions detected utilizing two detectors.

A second reason to vary the number of slots is to allow for more than one detector to be used. This is a significant advantage of a linear or 2D ion trap over a 3D ion trap. Since in a three-dimensional ion trap, ions are injected along the same axis that the ions are detected, detection was only easily performed by detecting ions ejected in one direction. It is well know that when using resonance ejection mass selective instability scans, ions try to exit the trap in both directions in which the resonance signal is applied. Consequently in a 3D ion trap, up to 50% of the detectable ions are lost since they are ejected toward the ion source side. In the linear ion trap, putting slots along with corresponding detectors on both sections which have the resonance signals applied (central X rods) allows substantially all of the ejected ions to be detected using two detectors. This is schematically shown in FIG. 5 where the opposing X rods X1C, X2C are slotted and detectors D1, D2 are associated with each. This essentially doubles the sensitivity of analysis versus a single detector system. FIG. 6 shows that precisely a factor of two in signal is gained when using two detectors.

Other reasons to include more than one slot for detection is to utilize the multiple detectors to detect analytes with different characteristics. For example, mass analysis of unknown samples may require ionization with either positive or negative polarity. Not knowing which ion polarity is required beforehand necessitates the provision of rapid switching of the instrument polarity to allow both polarity of ions to be detected in a reasonable time frame. Several processes limit the speed at which the instrument can be switched from one polarity to another. The polarity of the ion source spray voltage must be switched, which requires a rapid change of a several kilivolt voltage. Next, a stabilization time is required to allow the electrospray process producing ions to stabilize. In addition, the switching of the polarity of the conversion dynode voltage is required. Since the conversion dynode uses the highest voltage in the system (typically 10–15 KV, it typically requires the longest amount of time to switch. Total switching times can be in excess of 0.5 seconds on reasonably priced power supplies, although for substantially more cost, this time can be reduced.

Conventionally, when using two detectors to collect ions that are ejected symmetrically in the X-direction, the two detectors are run in the same polarity with the dynodes for each detector physically connected together so that a single power supply is used. The solution to the switching time issue is to separate the dynodes allowing one to be operated with a positive polarity whilst the other is simultaneously operated with a negative polarity.

Separation or decoupling of the dynodes has several benefits. For the positive/negative switching experiment, the switching time of the dynodes would no longer be a limitation since one of the detectors is always operating in the desired mode. In this instance, the dynodes would be decoupled, but the signals emanating from the electron multiplier anodes could be coupled into one detector circuit. In a more sophisticated experiment, where ions of both polarities are contained in the ion trap, a scan could simultaneously produce positive and negative ion spectra. This would require that the electron multiplier anodes also be separated and that two independent or decoupled detector circuits be available to differentiate ion polarity. Ions of both polarities can be formed in the trap or can be injected using two different ion sources which are readily coupled to the trap 11, one at each axial end as shown in FIG. 8, or by accumulating the two polarity of ions at different times. Thus, the capabilities of such a system would enable several modes of operation to be attained with one apparatus. In one mode of operation, two detectors of different polarities could be turned on simultaneously, one of positive polarity, the other of negative polarity. One could then either detect positive and negative ions either sequentially or simultaneously, depending upon the nature of the experiment. In a less advantageous mode of operation, two detectors of different polarity could be provided, but only one detector of a particular polarity switched on at any given time. A disadvantage of all of these methods utilizing the two detectors for different polarities is that since both positive and negative ions are normally ejected through both slots, one would only be able to detect half of the total number of ions of each particular polarity.

These general ideas can be extended further. The possibility exists of detecting ions radially in up to four directions requiring up to four slots and four detectors and would also allow the utilization of the X and Y ejection directions for different purposes. Resonance ejection in the ion trap is typically shown as being in one radial direction, the X direction. However, it is also possible to provide slots in the Y rods and to provide detectors therewith and excite the Y rods with an AC resonance voltage. In this case the, two polarity experiment discussed above can be performed in different directions. For example, the two Y detectors can be set for positive polarity ions while the X detectors can be set for negative ions. Another possibility of using more than one detector and utilizing the Y directions, is that the resonance ejection could, for example, be configured such that two different mass ranges, (ions of high or low mass), are simultaneously or sequentially scanned out, or possibly different charge states are scanned out in the different directions. This would require separate AC signals to be applied differentially to the X and to the Y rod pairs respectively. Typically, resonance ejection is performed at a fairly high q value which corresponds to frequencies nearly ½ the frequency of the main rf frequency. Ions having a m/z at some low value of interest are placed at this q value. Then the rf amplitude is scanned linearly up to some maximum voltage which ejects ions up to some maximum m/z by moving their q value to the ejection q. Now, by applying a second resonance ejection signal on say the Y rods at a fairly low q value, a higher mass range will be ejected at this q value simultaneously as ions are ejected at the higher q value when the rf amplitude is ramped. For example the X direction could scan M/Z 200–2000 while the Y direction would scan M/Z 2000–20,000. The foregoing use of 4 detectors is illustrated in FIG. 7 wherein all rods are shown with slots 12 and detectors D1, D2, D3 and D4 associated therewith.

The use of lower resonance ejection q values (e.g. q-0.44) for scanning ions out in high mass mode can be characterized as having worse sensitivity versus higher q values (e.g. 0.88) due to the different ejection characteristics Ion clouds ejected at low q values do not form a sufficiently dense ion packet during ejection to go through a narrow slot, for instance a slot that is 0.25 mm wide. The result is that the ion packet can be clipped and would result in signal loss.

One possibility offered by the current invention is a geometry that incorporates detectors in the X and Y directions, where the rods have slots which are different in the respective directions. (In this example, the slot in the rod in the X direction is juxtaposed the slot in the rod in the Y direction). This would allow optimization of the performance in each direction in accordance with their respective use. Specifically, the dimensions of the slots which incorporates a length, a width, and a depth, the slots being disposed at a distance relative to another feature, such as the apex of a hyperbolic rod differ in at least one dimension in the rods for the X direction from the slot(s) in the in the rods for the Y direction. For example, for a set of 4 mm radii rods, the slot in the X-direction pair of rods may be of a normal size, that is have a width of 0.25 mm and a depth of 1 mm, whilst those in the Y-direction are wider, say 0.5 mm or more, but for the same depth of 1 mm. This particular dimensioning could allow ions considered to be in the normal mass range to be extracted in the X-direction, while high mass ions are ejected in the Y-direction through the wider slot. The larger slots in the Y-direction rods could have some influence on mass resolution for ions ejected through the X-direction rods, but this effect is moderate and other changes can be done to correct this such as appropriate shaping of the X and/or Y rods respectively. The resonance ejection scheme could be configured such that a different mass range from the mass range scanned out in the X direction is either simultaneously or sequentially performed in the Y-direction and could utilize two or more separate detectors. Another possibility is to have the slots in opposite x or y electrodes have different dimensions along with a detector associated with each of said slots. Although odd ordered field distortions would result, resonance ejection could be carried out for example to sequentially scan out two different mass ranges. It is also possible to scan four mass ranges by providing slots of different dimensions in each rod, along with a detector associated with each of the slots.

Utilization of the available axial direction can also be implemented. A fifth detector could be added here to simply be able to measure total ion current when the ion cloud is pulsed out in this direction by lowering the back section potential. The available axial direction could be used for a second source of ions or electrons which would enhance the applicability of the ion trap system for different types of analytes. As mentioned above, positive and negative ion sources 61 and 62 can be used to inject ions into the ion trap from opposite directions. The use of this arrangement would include fundamental ion recombination studies, a method of ion activation based upon recombination of negative ions or electrons with positive ions, or a method of reducing space charge effects using oppositely charged particles.

Alternatively, the available axial direction could be used to couple the linear trap to another mass analyzer such as a Fourier transform mass spectrometer, RF quadrupole analyzer, time of flight mass analyzers, other three or two-dimensional ion traps, or other types of mass analyzer in a hybrid configuration. Hybrid mass spectrometers are well known to combine the strengths of different type of mass analyzers into a single instrument. As mentioned, the option also exists to couple several linear ion traps together in the axial direction.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

The invention claimed is:

1. A linear ion trap for trapping and subsequently ejecting ions comprising:

at least four spaced substantially parallel elongated electrodes, said electrodes each including at least a front, a center and a back segment, said center segment of said electrodes defining therebetween an elongated trapping volume, said elongated trapping volume having a center axis, at least two of the at least four electrodes including an elongated slot, the first of the at least two slots defined by a first set of dimensions, the second of the at least two slots defined by a second set of dimensions, and the first set of dimensions having at least one dimension that is different from the second set of dimensions.

2. A linear ion trap as in claim 1, wherein the first of the at least two slots is juxtaposed the second of the at least two slots.

3. A linear ion trap as in claim 2, wherein the at least four elongated electrodes comprises at least two sets of electrodes, and the first of the at least two slots is disposed in the first of the at least two sets of rods, and the second of the at least two slots is disposed in the second of the at least two sets of rods.

4. A linear ion trap as in claim 1, wherein the at least one dimension is the length of the slot.

5. A linear ion trap as in claim 1, wherein the at least one dimension is the width of the slot.

6. A linear ion trap as in claim 1, wherein the electrodes are hyperbolic in shape and wherein the center of the slot is substantially in line with the apex of the hyperbola.

7. A linear ion trap as in claim 6, wherein the at least one dimension is the position of the slot relative to the apex of the hyperbola.

8. A linear ion trap as in claim 1, further comprising detector means associated with each of said slots for detecting ions which are ejected therefrom.

9. A linear ion trap as in claim 8, wherein at least two of the detector means are not coupled to one another.

10. A linear ion trap as in claim 8, wherein the detector means comprises a dynode.

11. A linear ion trap as in claim 10, wherein the detector means are not coupled in a manner such that the dynodes are not coupled, and the signals emanating from the detector means are coupled.

12. A linear ion trap as in claim 10, wherein the detector means are not coupled in a manner such that the dynodes are not coupled, and the signals emanating from the detector means are not coupled.

13. A linear ion trap as in claim 8, wherein at least one of the detection means detects ions of a first nature, and at least one other of the detection means detects ions of a second nature.

14. A linear ion trap as in claim 13, wherein the first nature is negative ions and the second nature is positive ions.

15. A linear ion trap as in claim 13, wherein the first nature is higher mass ions and the second nature is lower mass ions.

16. A linear ion trap as in claim 13, wherein the first nature is of a first polarity and the second nature is of a second polarity.

17. A linear ion trap as in claim 13, wherein the first nature is of a first mass range and the second nature is of a second mass range.

18. A linear ion trap as in claim 13, wherein the first nature is of a first number of charges or charge state, and the second nature is of a second number of charges or charge state.

19. A mass spectrometer comprising:

a linear ion trap for trapping and subsequently ejecting ions, said linear ion trap including at least four spaced substantially parallel elongated electrodes each including at least a front, a center and a back segment, said center segment of said electrodes defining therebetween an elongated trapping volume having a center axis, at least two of the at least four electrodes including an elongated slot, the first of the at least two slots defined by a first set of dimensions, the second of the at least two slots defined by a second set of dimensions, and the first set of dimensions having at least one dimension that is different from the second set of dimensions;

means for introducing ions into said trapping volume to form an ion cloud; and means for applying trapping and ejection voltages to selected electrode segments to trap and eject ions from said trap through said elongated slot.

20. A mass spectrometer as in claim 19, wherein the first of the at least two slots is juxtaposed the second of the at least two slots.

21. A mass spectrometer as in claim 19, wherein the at least four elongated electrodes comprises at least two sets of electrodes, and the first of the at least two slots is disposed in the first of the at least two sets of rods, and the second of the at least two slots is disposed in the second of the at least two sets of rods.

22. A mass spectrometer as in claim 19, wherein the at least one dimension is the length of the slot.

23. A mass spectrometer as in claim 19, wherein the at least one dimension is the width of the slot.

24. A mass spectrometer as in claim 19, wherein the electrodes are hyperbolic in shape and wherein the center of the slot is substantially in line with the apex of the hyperbola.

25. A mass spectrometer as in claim 19, wherein the at least one dimension is the position of the slot relative to the apex of the hyperbola.

26. A method for analyzing ions of at least two natures contained in a linear ion trap which comprises at least four spaced substantially parallel elongated electrodes, the electrodes each including at least a front, a center and a back segment, said center segment of said electrodes defining therebetween an elongated trapping volume, said elongated trapping volume having a center axis, at least two of the at least four electrodes including an elongated slot, and detector means associated with each slot for detecting ions which are ejected therefrom; the method comprising the step of having said detector means associated with each slot activated simultaneously.

27. The method as in claim 26, wherein the at least two natures of ions are detected simultaneously.

28. The method as in claim 26, wherein the at least two natures of ions are detected sequentially.

29. The method as in claim 26, wherein the first nature is negative ions and the second nature is positive ions.

30. The method as in claim 26, wherein the first nature is higher mass ions and the second nature is lower mass ions.

31. The method as in claim 26, wherein the first nature is of a first polarity and the second nature is of a second polarity.

32. The method as in claim 26, wherein the first nature is of a first mass range and the second nature is of a second mass range.

33. The method as in claim 26, wherein the first nature is of a first number of charges or charge state, and the second nature is of a second number of charges or charge state.

34. A method for analyzing ions of at least two natures contained in a linear ion trap which comprises at least four spaced substantially parallel elongated electrodes, the electrodes each including at least a front, a center and a back segment, said center segment of said electrodes defining therebetween an elongated trapping volume, said elongated trapping volume having a center axis, at least two of the at least four electrodes including an elongated slot, and detector means associated with each of the slots for detecting ions which are ejected therefrom; the method comprising the step of having said detector means associated with each of the slots activated sequentially.

35. The method as in claim 34, wherein the first nature is negative ions and the second nature is positive ions.

36. The method as in claim 34, wherein the first nature is higher mass ions and the second nature is lower mass ions.

37. The method as in claim 34, wherein the first nature is of a first polarity and the second nature is of a second polarity.

38. The method as in claim 34, wherein the first nature is of a first mass range and the second nature is of a second mass range.

39. The method as in claim 34, wherein the first nature is of a first number of charges or charge state, and the second nature is of a second number of charges or charge state.

* * * * *